US010795291B2

(12) United States Patent
Matsuo

(10) Patent No.: US 10,795,291 B2
(45) Date of Patent: Oct. 6, 2020

(54) FIXATION APPARATUS AND IMAGE FORMING APPARATUS PROVIDING IMPROVED GLOSSINESS

(71) Applicant: Konica Minolta, Inc., Tokyo (JP)

(72) Inventor: Ryohei Matsuo, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/380,596

(22) Filed: Apr. 10, 2019

(65) Prior Publication Data

US 2019/0324391 A1 Oct. 24, 2019

(30) Foreign Application Priority Data

Apr. 19, 2018 (JP) ..... 2018-080579

(51) Int. Cl.
*G03G 15/20* (2006.01)

(52) U.S. Cl.
CPC . *G03G 15/2053* (2013.01); *G03G 2215/2035* (2013.01); *G03G 2215/2038* (2013.01)

(58) Field of Classification Search
CPC ..... G03G 15/2053; G03G 15/2017; G03G 2215/2035; G03G 2215/2038; G03G 2215/2041; G03G 2215/2045
USPC ..... 399/329; 219/216
See application file for complete search history.

(56) References Cited

U.S. PATENT DOCUMENTS 7,149,464 B2 * 12/2006 Yoneda ..... G03G 15/2064 399/329
7,171,150 B2 * 1/2007 Yonekawa ..... G03G 15/2064 399/329
7,560,216 B2 * 7/2009 Sugiyama ..... G03G 9/0819 430/123.41
8,995,896 B2 * 3/2015 Amano ..... G03G 15/2064 399/329
9,804,547 B2 * 10/2017 Yamagishi ..... G03G 15/2053
2014/0199101 A1 * 7/2014 Miki ..... G03G 15/2053 399/329

FOREIGN PATENT DOCUMENTS

JP H05-165357 A 7/1993
JP 2003-091110 A 3/2003
JP 2003-330299 A 11/2003
JP 2004-012870 A 1/2004
JP 2004184446 A * 7/2004

(Continued)

*Primary Examiner* — Robert B Beatty
(74) *Attorney, Agent, or Firm* — Lucas & Mercanti, LLP

(57) ABSTRACT

A fixation apparatus includes a fixation belt, an opposing rotating body, and a nip forming member. A nip most upstream portion corresponding to a most upstream portion of a fixation nip portion in a direction of transportation of a recording medium is defined in the nip forming member. The nip forming member includes a curved nip upstream portion which is provided at the nip most upstream portion and projects with respect to the opposing rotating body. The nip upstream portion is shaped to produce a speed difference between a side of a toner image where the toner image and the fixation belt are in contact with each other in a thickness direction of the recording medium and a side of the toner image where the toner image and the recording medium are in contact with each other in the thickness direction.

12 Claims, 14 Drawing Sheets

(56) References Cited

FOREIGN PATENT DOCUMENTS

| | | | | |
|---|---|---|---|---|
| JP | 2011-085873 | A | | 4/2011 |
| JP | 2011-158810 | A | | 8/2011 |
| JP | 2013246202 | A | * | 12/2013 |
| JP | 2017173613 | A | * | 9/2017 |

* cited by examiner

FIXATION APPARATUS AND IMAGE FORMING APPARATUS PROVIDING IMPROVED GLOSSINESS

The entire disclosure of Japanese Patent Application No. 2018-080579 filed on Apr. 19, 2018 is incorporated herein by reference in its entirety.

BACKGROUND

Technological Field

The present invention relates to a fixation apparatus and an image forming apparatus.

Description of the Related Art

Japanese Laid-Open Patent Publications Nos. 2011-158810, 2011-85873, 2004-12870, 2003-330299, 2003-91110, and 5-165357 disclose a technique for adjusting glossiness in a conventional fixation apparatus.

SUMMARY

An approach to increase a duration of passage through a fixation nip portion (a duration of nipping) or to increase a fixation temperature has been available as an approach to increase glossiness in a conventional fixation apparatus. In order to increase a duration of nipping, a diameter of a roller or a length of a pad member should be increased, which, however, leads to increase in amount of deformation of the roller and may lead to deterioration of durability.

On the other hand, increase in fixation temperature leads to increase in energy consumption and further to great influence on thermal deterioration of each member. Furthermore, a cooling function should be enhanced.

An object of the present invention is to provide a fixation apparatus and an image forming apparatus capable of achieving higher glossiness with a simplified configuration.

To achieve at least one of the abovementioned objects, according to an aspect of the present invention, a fixation apparatus reflecting one aspect of the present invention fixes a toner image formed on a recording medium. The fixation apparatus includes a fixation belt, an opposing rotating body, a nip forming member, and a heating portion. The endless fixation belt is rotatably constructed. The nip forming member is arranged on an inner circumferential side of the fixation belt. The opposing rotating body is opposed to the nip forming member and an outer circumferential surface of the fixation belt to form a fixation nip portion. The heating portion supplies heat to the toner image. In the nip forming member, a nip most upstream portion corresponding to a most upstream portion of the fixation nip portion in a direction of transportation of the recording medium is defined. The nip forming member includes a curved nip upstream portion which is provided at the nip most upstream portion and projects with respect to the opposing rotating body. The nip upstream portion is shaped to produce a speed difference between a side of the toner image where the toner image and the fixation belt are in contact with each other in a thickness direction of the recording medium and a side of the toner image where the toner image and the recording medium are in contact with each other in the thickness direction.

To achieve at least one of the abovementioned objects, according to an aspect of the present invention, an image forming apparatus reflecting one aspect of the present invention comprises the fixation apparatus described above and an accommodation portion which accommodates a recording medium to be transported to the fixation apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
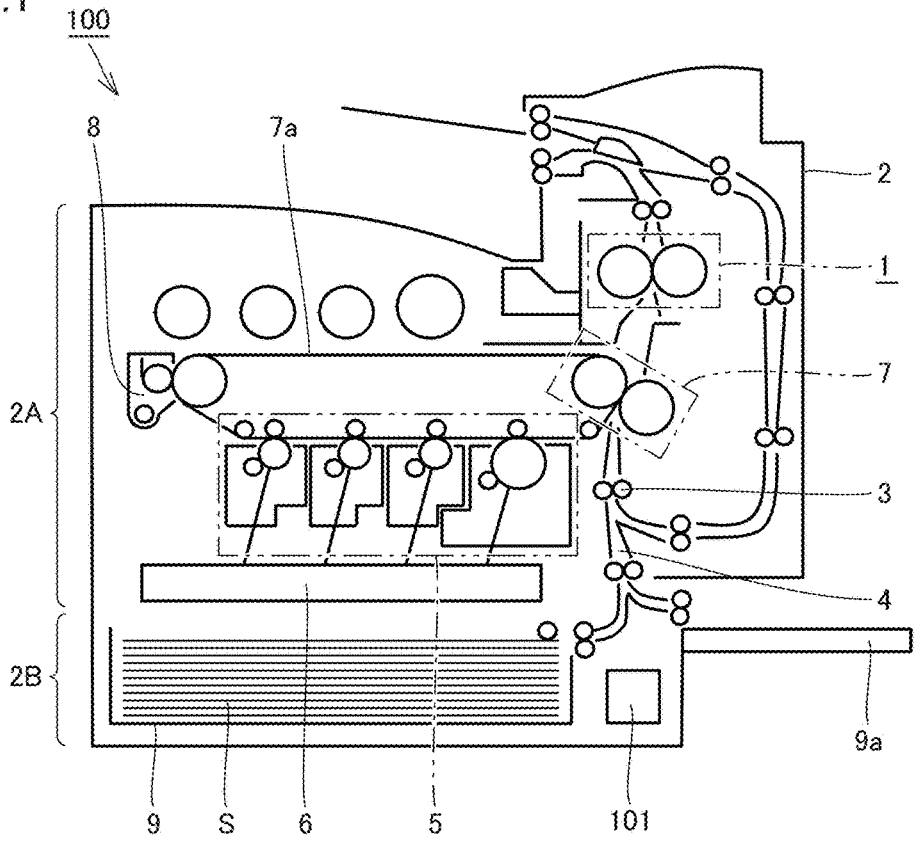
FIG. 1 is a schematic diagram of an image forming apparatus in an embodiment.

Hereinafter, one or more embodiments of the present invention will be described with reference to the drawings. However, the scope of the invention is not limited to the disclosed embodiments.

In an embodiment shown below, what is called a tandem type electrophotographic color printer and an image forming apparatus equipped therein are exemplified as an image forming apparatus for description. In the embodiment shown below, the same or common elements in the drawings have the same reference characters allotted and description thereof will not be repeated.

<Image Forming Apparatus 100>

FIG. 1 is a schematic diagram of an image forming apparatus 100 in art embodiment. A schematic construction of and operations by image forming apparatus 100 in the embodiment will be described with reference to FIG. 1.

Image forming apparatus 100 mainly includes an apparatus main body 2, an accommodation portion 9, and a control device 101. Apparatus main body 2 includes an image forming portion 2A which is a portion for forming an image on paper S as a recording medium and a paper feed portion 2B which is a portion for supplying paper S to image forming portion 2A. Accommodation portion 9 accommodates paper S to be supplied to image forming portion 2A and a fixation apparatus 1 which will be described later, and it is removably provided in paper feed portion 2B.

A plurality of rollers 3 are provided in image forming apparatus 100 so that a transportation path 4 through which paper S is transported along a prescribed direction is defined across image forming portion 2A and paper feed portion 2B described above. As shown in FIG. 1, apparatus main body 2 may separately be provided with a manual feed tray 9*a* for supplying paper S to image forming portion 2A.

Image forming portion 2A mainly includes an imaging unit 5 capable of forming a toner image, for example, of each of yellow (Y), magenta (M), cyan (C), and black (K), an exposure unit 6 for exposing a photoconductor included in imaging unit 5 to light, an intermediate transfer belt 7*a* supported by imaging unit 5 under tension, a transfer portion 7 provided on a track of intermediate transfer belt 7*a* and on transportation path 4, a cleaning portion 8, and fixation apparatus 1 provided on transportation path 4 in a portion downstream from transfer portion 7 which will be described later.

Control device 101 controls entire image forming apparatus 100. Control device 101 transmits a signal in accordance with an image to be formed on paper S to exposure unit 6. Exposure unit 6 drives exposure means of each color (means including a polygon mirror and laser, or a line light-emitting element of an LED) based on a signal from control device 101.

An interval of exposure for forming a finalized toner image is predetermined, with d [dpi] representing a resolution (dot density) of a finalized toner image to be formed on paper S. The interval is determined in accordance with the resolution [dpi]. The interval is set to 42.3 [μm] when the resolution is set to 600 [dpi] and set to 21.2 [μm] when the resolution is set to 1200 [dpi].

A "finalized toner image" and a "toner image" which ill be described later herein refer to a state after fixation and a state before fixation, respectively.

Imaging unit 5 forms a toner image of each of yellow (Y), magenta (M), cyan (C), and black (K) or a toner image only of black (K) on a surface of the photoconductor upon receiving exposure light from exposure unit 6 and transfers the toner image to intermediate transfer belt 7*a* (what is called primary transfer). A colored toner image or a monochrome toner image is thus formed on intermediate transfer belt 7*a*.

Intermediate transfer belt 7*a* moves the colored toner image or the monochrome toner image formed on its surface to transfer portion 7, and it is brought in press contact in transfer portion 7 together with paper S transported from paper feed portion 2B to transfer portion 7. The colored toner image or the monochrome toner image formed on the surface of intermediate transfer belt 7*a* is thus transferred to paper S (what is called secondary transfer).

After transfer portion 7 transfers the colored toner image or the monochrome toner image to paper S, paper S is separated from intermediate transfer belt 7*a* owing to a curvature and cleaning portion 8 removes residual toner from intermediate transfer belt 7*a*.

Paper S to which the colored toner image or the monochrome toner image has been transferred is thereafter pressurized and heated by fixation apparatus 1 so that the toner image formed on paper S is fixed. A finalized color image or a finalized monochrome image is thus formed on paper S and paper S on which the finalized color image or the finalized monochrome image is formed is thereafter ejected from apparatus main body 2.

(Fixation Apparatus 1)

Figure 2:
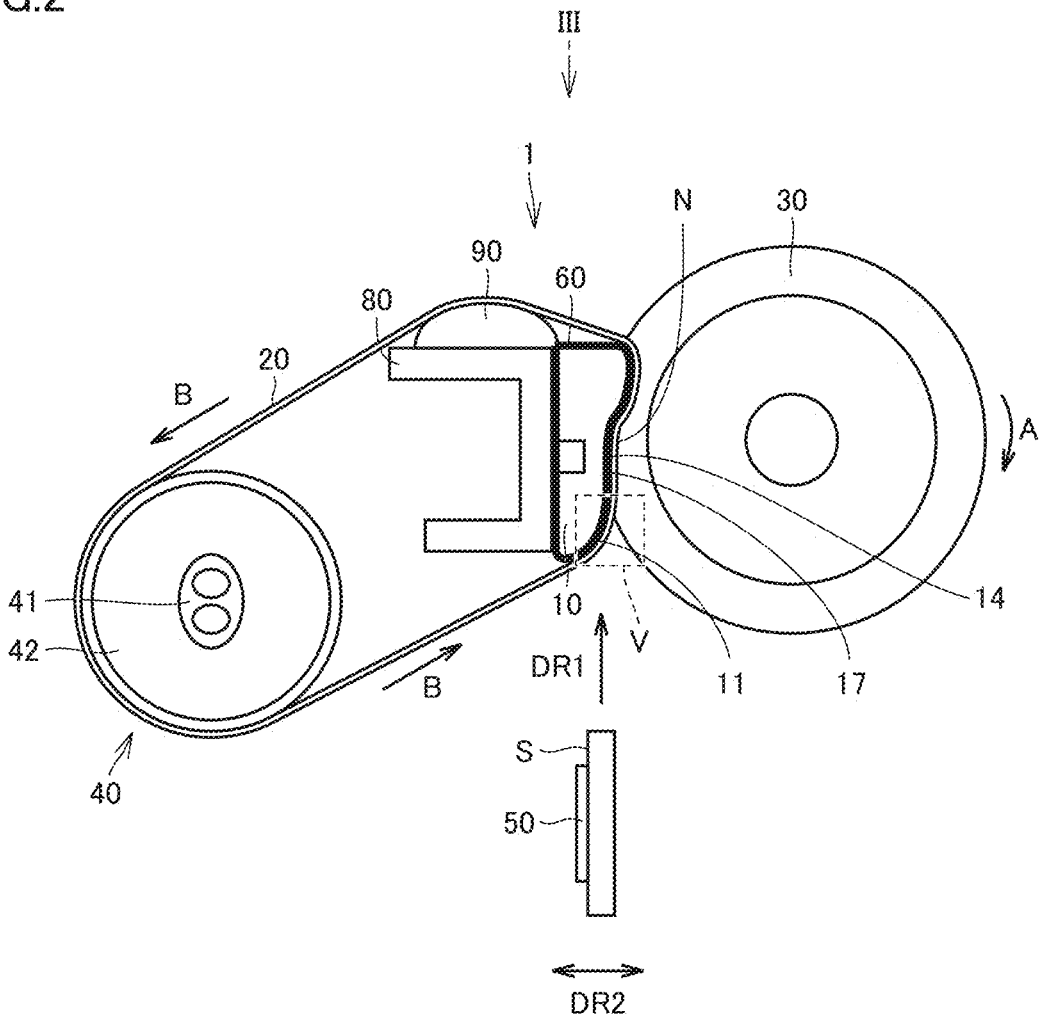
FIG. 2 is a schematic cross-sectional view of a fixation apparatus in the embodiment.
Figure 3:
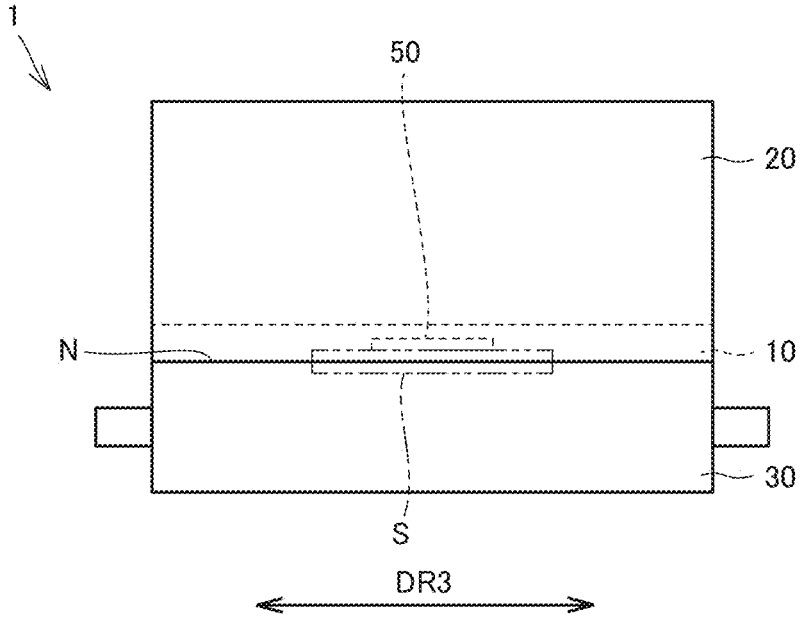
FIG. 3 is a diagram showing overview of a construction of a fixation apparatus viewed in a direction shown with III in FIG. 2.

FIG. 2 is a schematic cross-sectional view of fixation apparatus 1 in the embodiment. FIG. 3 is a diagram showing overview of a construction of fixation apparatus 1 viewed in a direction shown with III in FIG. 2. Fixation apparatus 1 will be described with reference to FIGS. 2 and 3.

Fixation apparatus 1 includes a rotatably constructed endless fixation belt 20, a heating portion 40, an opposing rotating body, a nip forming member 10, a fixing member 80, a lubricant application portion 90, and a slide sheet 60.

Arrows shown in FIG. 2 indicate a direction of transportation DR1 and a thickness direction DR2, respectively. Direction of transportation DR1 refers to a direction of transportation of paper S and is defined as an upward direction in FIG. 2. Thickness direction DR2 refers to a thickness direction of paper S and is defined as a lateral direction in FIG. 2. A double-headed arrow shown in FIG. 3 indicates a width direction DR3. Width direction DR3 is a direction orthogonal to direction of transportation DR1 and thickness direction DR2 and refers to a width direction of fixation belt 20. Width direction DR3 is defined as a lateral direction in FIG. 3 in parallel to axial direction of a pressure roller 30 which will be described later.

Fixation belt 20 has any outer diameter, and the outer diameter is set, for example, to 70 [mm], Fixation belt 20 includes a base layer, an elastic layer, and a release layer. The base layer is composed, for example, of polyimide (PI). The base layer has a thickness, for example, of 80 [μm].

A highly heat-resistant material such as silicone rubber and fluorine rubber is preferred for the elastic layer. The elastic layer has a thickness, for example, of 200 [μm]. The release layer is preferably formed of a material with releasability such as a fluorine tube and a fluorine-based coating. The release layer is formed, for example, from a tetrafluoroethylene-perfluoroalkyl vinyl ether copolymer (PFA) tube. The release layer has a thickness, for example, of 30 [μm].

Nip forming member 10 is arranged on an inner circumferential side of fixation belt 20. Nip forming member 10 is provided as being fixed by fixing member 80 and slides with respect to an inner circumferential surface of fixation belt 20. Nip forming member 10 is composed, for example, of a liquid crystal polymer (LCP). Details of nip forming member 10 will be described later.

In the embodiment, the opposing rotating body is implemented by pressure roller 30. Pressure roller 30 is rotated by a drive apparatus (not shown) such as a motor, for example, at 415 [mm/s] (a direction shown with A in FIG. 2). Fixation belt 20 is rotated as being driven by rotation of pressure roller 30 (a direction shown with B in FIG. 2).

Pressure roller 30 has an outer diameter, for example, of 50 [mm]. Pressure roller 30 includes a core made of iron, an elastic layer, and a release layer. The core has a thickness, for example, of 40 [mm]. The elastic layer has a thickness, for example, of 5 [mm]. The release layer is formed, for example, from a PFA tube. The release layer has a thickness, for example, of 20 [mm].

Pressure roller 30 presses nip forming member 10 with fixation belt 20 being interposed. Pressure roller 30 defines a fixation nip portion N by being opposed to nip forming member 10 and an outer circumferential surface of fixation belt 20. Fixation nip portion N is a region defined by pressing of nip forming member 10 by pressure roller 30. In fixation nip portion N, a toner image 50 on paper S is heated and pressurized and fixed to paper S.

Magnitude of a load in fixation nip portion N is, for example, not lower than 700 [N] and not higher than 1000 [N]. Fixation nip portion N has a width in direction of transportation DR1 (a nip width), for example, of 18 [mm] Fixation nip portion N in width direction DR3 has a length, for example, of 320 [mm].

Toner image 50 is formed on paper S. Paper S has a length in thickness direction DR2, for example, of 140 [μm]. Paper S is transported in direction of transportation DR1 by a not-shown miler and enters fixation nip portion N together with toner image 50.

Slide sheet 60 is arranged between nip forming member 10 and the inner circumferential surface of fixation belt 20. Slide sheet 60 lowers friction force generated between nip forming member 10 and the inner circumferential surface of fixation belt 20. Slide sheet 60 is fixed as wrapping around nip forming member 10.

Slide sheet 60 is preferably made of a highly wear-resistant and heat-resistant material such as a fluorine resin fabric (MS fabric) manufactured by Chukoh Chemical Industries, Ltd. or a cross-linked fluorine resin FEX® manufactured by Sumitomo Electric Fine Polymer, Inc. Slide sheet 60 is formed, for example, from a glass cloth of a type impregnated with a fluorine resin.

Lubricant application portion 90 is arranged downstream from nip forming member 10 in a direction of rotation of fixation belt 20. Lubricant application portion 90 is fixed by fixing member 80. Lubricant application portion 90 is arranged on the inner circumferential side of fixation belt 20 and supports fixation belt 20.

Lubricant application portion 90 applies a lubricant to the inner circumferential surface of fixation belt 20. Silicone oil or fluorine grease may be employed as the lubricant. KF96-300CS manufactured by Shin-Etsu Silicone is preferred for silicone oil, and G8005 manufactured by Dow Corning Toray Co., Ltd. is preferred for fluorine grease. The lubricant is provided between the inner circumferential surface of fixation belt 20 and slide sheet 60. When no slide sheet 60 is provided, the lubricant is provided between the inner circumferential surface of fixation belt 20 and nip forming member 10.

Lubricant application portion 90 holds a not-shown felt. The felt is in contact with the inner circumferential surface of fixation belt 20. The felt is impregnated with the lubricant. Lubricant application portion 90 can thus uniformly apply the lubricant to the inner circumferential surface of fixation belt 20.

Heating portion 40 is arranged on the inner circumferential side of fixation belt 20. Heating portion 40 includes a heat source 41 and a heating roller 42. Heating roller 42 has an outer diameter, for example, of 40 [mm]. An aluminum portion of heating roller 42 has a thickness, for example, of 0.7 [mm]. A surface of heating roller 42 is coated with polytetrafluoroethylene (PTFE). A coating layer has a thickness, for example, of 40 [μm].

Output of heat source 41 (a heater or the like) is set, for example, to 1000 [W]. A conditioned temperature is set, for example, to 170 [° C.]. Heat source 41 heats fixation belt 20 with heating roller 42 being interposed. In the embodiment, heat source 41 supplies heat to toner image 50 with fixation belt 20 being interposed. Heating roller 42, nip forming member 10, and lubricant application portion 90 support fixation belt 20 under tension.

(Nip Forming Member 10)

Figure 4:
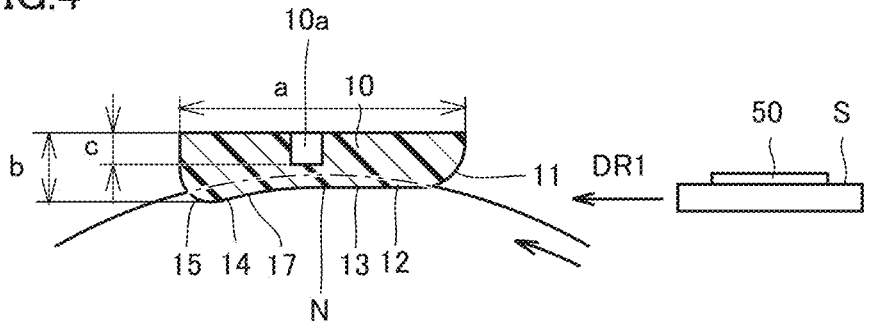
FIG. 4 is a schematic cross-sectional view of a nip forming member in the embodiment.

FIG. 4 is a schematic cross-sectional view of nip forming member 10 in the embodiment. For clearly showing a shape of pressure roller 30 before elastic deformation, FIG. 4 shows the shape before deformation of pressure roller 30 with a chain double dotted line.

Nip forming member 10 includes an opposing surface 17. Opposing surface s opposed to the inner circumferential surface of fixation belt 20. Opposing surface 17 is a surface which faces pressure roller 30. A surface of pressure roller 30 is elastically deformed as conforming to a surface profile of opposing surface 17.

Nip forming member 10 has a length (a in FIG. 4) in direction of transportation DR1, for example, of 27.5 [mm]. A length (b in FIG. 4) from a rear surface of nip forming member 10 to a portion of opposing surface 17 most distant from the rear surface is, for example, 6.47 [mm]. A hole 10*a* is provided in nip forming member 10. A part of fixing member 80 is inserted in, hole 10*a*. Hole 10*a* has a depth (c in FIG. 4), for example, of 3 [mm]. Strength of nip forming member 10 is thus ensured.

Opposing surface 17 includes a curved nip upstream portion 11 and a nip downstream portion 12. Nip upstream portion 11 is provided at a most upstream portion of opposing surface 17 in direction of transportation DR1. Nip upstream portion 11 is opposed to pressure roller 30 with paper S and fixation belt 20 being interposed.

Nip upstream portion 11 is curved in a cross-section orthogonal to width direction DR3 (a cross-section Z below). In cross-section Z, nip upstream portion 11 is in a shape of an arc. Nip upstream portion 11 projects with respect to pressure roller 30. An arc portion of nip upstream portion 11 has an even curvature. Nip upstream portion 11 has a radius of curvature, for example, of 5 [mm]. Nip downstream portion 12 smoothly continuing to nip upstream portion 11 is provided downstream from nip upstream portion 11 in direction of transportation DR1.

Nip downstream portion 12 is different in curvature from nip upstream portion 11. A curvature at the most downstream portion of nip upstream portion 11 in direction of transportation DR1 is different from a curvature at the most upstream portion of nip downstream portion 12 in direction of transportation DR1. The curvature varies at a boundary between nu upstream portion 11 and nip downstream portion 12. Nip downstream portion 12 includes a planar portion 13, a curved portion 14, and a projecting portion 15.

Planar portion 13 is smooth. Planar portion 13 is in a linearly extending shape in cross-section Z. Planar portion 13 smoothly continues to nip upstream portion 11. A curvature of planar portion 13 is substantially zero over the entire planar portion 13. Curved portion 14 is provided downstream from planar portion 13 in direction of transportation DR1.

Curved portion 14 is concavely curved. Curved portion 14 is in a shape recessed (projecting) toward fixing member 80. Curved portion 14 has a radius of curvature, for example, of 39 [mm].

An amount of elastic deformation of pressure roller 30 in an area of contact between curved portion 14 and pressure roller 30 increases toward downstream in direction of transportation DR1. A nipping pressure in curved portion 14 thus increases toward downstream in direction of transportation DR1. Projecting portion 15 smoothly continuing to curved portion 14 is provided downstream from curved portion 14 in direction of transportation DR1.

Projecting portion 15 is curved. Projecting portion 15 is in a projecting shape projecting toward pressure roller 30. Projecting portion 15 projects in a direction opposite to a direction of projection of curved portion 14. Projecting portion 15 is opposite in direction of curvature to curved portion 14. Projecting portion 15 has a radius of curvature, for example, of 3 [mm]. Separability can thus be ensured without imposing a load to pressure roller 30 and fixation belt 20.

An amount of elastic deformation of pressure roller 30 increases in direction of transportation DR1 from planar portion 13 toward projecting portion 15. Nip forming member 10 is configured to have a nipping pressure increasing toward downstream in direction of transportation DR1. Nip upstream portion 11 is lower in nipping pressure than a portion in nip forming member 10 other than nip upstream portion 11 (nip downstream portion 12).

(Speed Difference in Toner Image 50)

Figure 5:
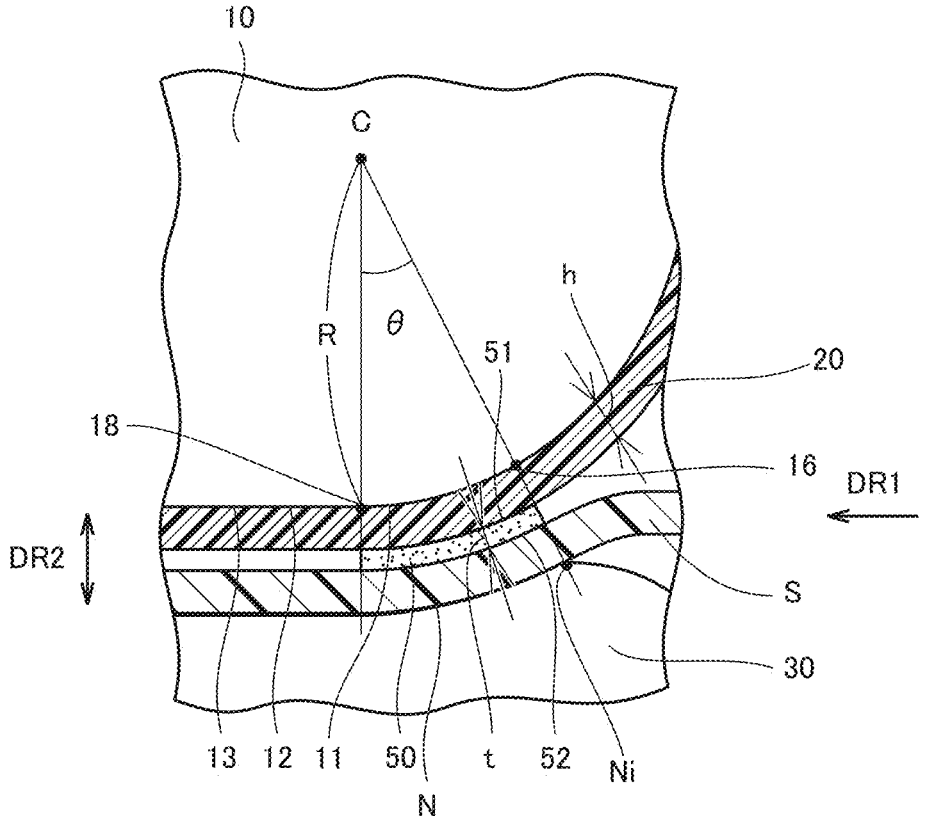
FIG. 5 is an enlarged schematic diagram of a region V shown in FIG. 2.

FIG. 5 is an enlarged schematic diagram of a region V shown in FIG. 2. Though FIG. 5 shows a state immediately after entry of paper S into fixation nip portion N, for the sake of convenience, it shows a state that a speed difference which will be described later has not been produced. A nip most upstream portion 16 is defined in nip forming member 10.

Nip most upstream portion 16 is a portion corresponding to the most upstream portion of fixation nip portion N (a nip entrance Ni below) in direction of transportation DR1. The "portion corresponding to nip entrance Ni" herein means a portion of nip forming member 10 opposed to nip entrance Ni and an intersection between a line which connects nip entrance Ni to a center of curvature C of nip upstream portion 11 and nip upstream portion 11.

Nip upstream portion 11 is provided at nip most upstream portion 16. Nip upstream portion 11 includes nip most upstream portion 16. Nip most upstream portion 16 is located in a region where nip upstream portion 11 extends.

A curvature boundary portion 18 is formed at a boundary between nip upstream portion 11 and planar portion 13 (nip downstream portion 12). An angle formed between a line segment which connects center of curvature C of nip upstream portion 11 to nip most upstream portion 16 and a line segment which connects center of curvature C of nip upstream portion 11 to curvature boundary portion 18 in cross-section Z is defined as an upstream nipping angle θ[°]. Upstream nipping angle θ[°] is set, for example, to 15[°].

Toner image 50 includes a surface portion 51 and an attachment surface 52. Surface portion 51 is in contact with fixation belt 20. Surface portion 51 is opposed to fixation belt 20. Surface portion 51 is provided on a side of toner in age where toner image 50 and fixation belt 20 are in contact with each other in thickness direction DR2 of paper S.

Attachment surface 52 is in contact with paper S. Attachment surface 52 is opposed to paper S. Attachment surface 52 is provided on a side of toner image 50 where toner image 50 and paper S are in contact with each other in thickness direction DR2 of paper S. Attachment surface 52 is provided on a side of toner image 50 which faces pressure roller 30.

A length L1 [μm] of attachment surface 52 in direction of transportation DR1 is expressed as $2\pi(R+t+h)\times\theta/360$ where R [μm] represents a radius of curvature of nip upstream portion 11, h [μm] kind represents a thickness of fixation belt 20, and t [μm] (tin FIG. 5) represents a thickness of toner image 50. A length L2 [μm] of surface portion 51 in direction of transportation DR1 is expressed as $2\pi(R+h)\times\theta/360$. A difference [μm] in length between surface portion 51 and attachment surface 52 is thus expressed as $L1-L2=2\pi\times t\times\theta/360$.

A difference in distance of travel is thus produced in direction of transportation DR1 of surface portion 51 and attachment surface 52 per unit time (a difference in distance of travel being referred to as a "path difference" below), without depending on magnitude of radius of curvature R of nip upstream portion 11 but depending on thickness t [μm] of toner image 50 and upstream nipping angle θ[°]. Since a path difference is produced, a difference is produced in a moving speed of surface portion 51 and attachment surface 52 along direction of transportation DR1 (such a difference in speed being referred to as a "speed difference" below).

Nip upstream portion 11 is shaped to produce a speed difference between a side of toner image 50 where toner image 50 and fixation belt 20 are in contact with each other in thickness direction DR2 and a side of toner image 50 where toner image 50 and a recording medium are in contact with each other in direction of transportation DR1.

Figure 6:
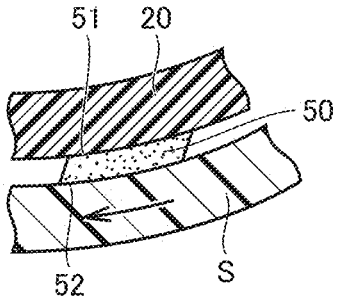
FIG. 6 is a schematic cross-sectional view showing a state that a speed difference is produced in a toner image.

FIG. 6 is a schematic cross-sectional view showing a state that a speed difference is produced in toner image 50. Since pressure roller 30 is driven to rotate at 415 [mm/s], paper S is also transported at 415 [mm/s] when paper S is linearly transported. In a region lying over curved nip upstream portion 11, however, a speed difference is produced between surface portion 51 and attachment surface 52.

A moving speed of attachment surface 52 along direction of transportation DR1 is higher than a moving speed of surface portion 51 along direction of transportation DR1. The moving speed of surface portion 51 is, for example, 412.7 [mm/s], whereas the moving speed of attachment surface 52 is, for example, 415.0 [mm/s]. The speed difference is calculated, for example, as 2.3 [mm/s]. When the speed difference is produced, viscous force of toner is produced and toner image 50 is deformed as being extended. With this function, surface portion 51 is smoothened and glossiness increases.

(Mechanism of Smoothening)

Figure 7:
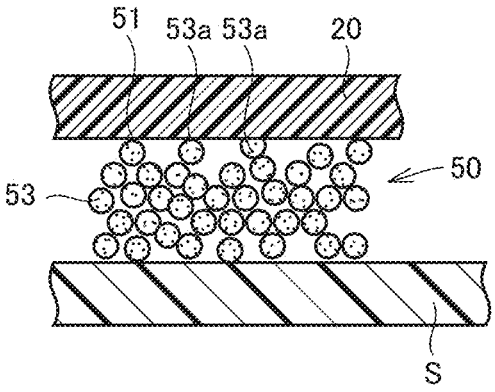
FIG. 7 is an enlarged schematic diagram of a toner image before a surface portion is smoothened.
Figure 8:
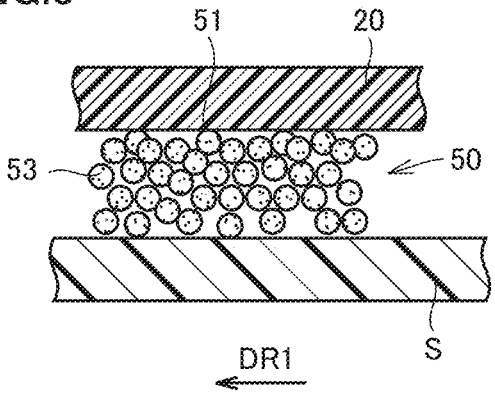
FIG. 8 is an enlarged schematic diagram of a toner image of which surface portion is smoothened as a result of production of a speed difference.

FIG. 7 is an enlarged schematic diagram of toner image 50 before surface portion 51 is smoothened. FIG. 8 is an enlarged schematic diagram of toner image 50 of which surface portion 51 is smoothened by production of a speed difference. As shown in FIGS. 7 and 8, much toner 53 forms toner image 50. As shown in FIGS. 7 and 8, toner image 50 is formed by layering of particulate toner 53.

When a speed difference is applied to toner image 50 as shown in FIG. 8, toner 53 (uppermost toner 53*a* below, see FIG. 7) in contact with fixation belt 20 is displaced in direction of transportation DR1. Uppermost toner 53*a* thus enters a space in a layer below. Therefore, surface portion 51 is smoothened and glossiness of paper S increases.

Figure 9:
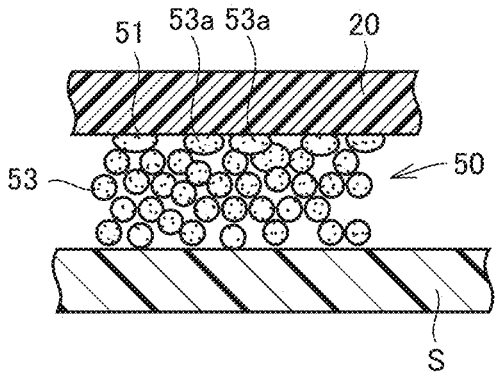
FIG. 9 is an enlarged schematic diagram of a toner image smoothened by extension of toner owing to production of a speed difference.

FIG. 9 is an enlarged schematic diagram of toner image 50 smoothened by extension of toner 53 owing to production of a speed difference. In FIG. 8, surface portion 51 is smoothened by displacement of uppermost toner 53*a* in direction of transportation DR1. In an example shown in FIG. 9, surface portion 51 is smoothened by extension of uppermost toner 53*a* as a result of conduction of heat from fixation belt 20 to uppermost toner 53*a* and resultant application of viscous force.

As shown in FIGS. 8 and 9, surface portion 51 is smoothened mechanisms of displacement and extension of uppermost toner 53*a*. Thus, as a guide for a path difference (an amount of displacement of toner), a path difference to such an extent as realizing movement of toner into a space between particles of toner 53 (half an average particle size x [μm] of toner 53) is enough. In the embodiment, average particle size x [μm] of toner 53 has been found as approximately 6 [μm] by measurement with a flow particle image analyzer FPIA-2100 (manufactured by Sysmex Corporation).

Toner 53 contains wax. Paraffin-based or ester-based wax is preferred.

When uppermost toner 53*a* is extended as shown in FIG. 9, wax is exuded by shear force from toner 53. A content of wax is preferably approximately nut lower than 10% and not higher than 20% with respect to a weight of toner 53, although it depends on a size or a weight of a base of toner 53. As a result of actual comparative tests of toner which contains 0%, 5%, and 10% of wax with respect to a weight of toner, glossiness in an example of a wax content of 5% was lower than glossiness in an example of a wax content of 0% or 10%.

(Function and Effect)

With curved nip upstream portion 11 as shown in FIG. 5, a speed difference dependent on thickness t [μm] of toner image 50 and upstream nipping angle θ[°] is produced between surface portion 51 and attachment surface 52 in nip upstream portion 11. Thus, heat is provided from fixation belt 20 to surface portion 51 when paper S enters fixation nip portion N and slight shear force (viscous force) as rubbing surface portion 51 is generated. This shear force smoothens surface portion 51. As smoothened surface portion 51 is heated and pressurized and fixed to paper S, glossiness of paper S is improved.

With curved nip upstream portion 11, glossiness can be increased based on a shape of nip forming member 10 alone without increasing a duration of nipping (a duration of passage through fixation nip portion N) or a fixation temperature. Glossiness can thus be increased with a simplified configuration.

Fixation belt 20 includes an elastic layer. Surface portion 51 can thus more uniformly be pressed. Therefore, higher glossiness is obtained.

When a high nipping pressure is applied in nip upstream portion 11, contact force between fixation belt 20 and pressure roller 30 increases. Production of a path difference is thus less likely. By making a nipping pressure in nip upstream portion 11 lower than in a portion other than nip upstream portion 11 (nip downstream portion 12), transportation capability of fixation belt 20 can be ensured. Therefore, production of a path difference is more likely.

Toner 53 contains wax. A wax layer is further layered on surface portion 51 by exudation of wax. Therefore, surface portion 51 becomes smoother and high glossiness is obtained.

Toner 53 contains preferably at least 10% and at most 20% of wax with respect to a weight of toner 53 alone. By setting a content of wax to at least 10%, an insufficient content of wax with respect to surface portion 51 which results in non-uniform wax and rough surface portion 51 can be suppressed. Therefore, by setting a content of wax to at least 10%, a sufficient amount of exudation of wax for surface portion 51 can be ensured and higher glossiness is obtained. Furthermore, separability between toner image 50 (paper S) and fixation belt 20 can be ensured.

By setting a content of wax to at most 20%, attachment of a volatile component of wax to pressure roller 30, fixation belt 20, and a guide can be suppressed. Image noise due to indentation by pressure roller 30 and paper jamming caused by deposits of wax can thus be suppressed.

Nip forming member 10 is configured to have a nipping pressure increasing toward a nip exit. Toner image 50 can thus be pressed not to leave an air layer in toner image 50. Glossiness can thus be enhanced. Furthermore, generation of image noise due to escape of the air layer from toner image 50 can be suppressed.

When friction force between the nip forming member and the inner circumferential surface of the fixation belt is great, such a slip phenomenon that the fixation belt does not follow rotation of the pressure roller and paper is not transported may occur. By arranging slide sheet 60 between nip forming member 10 and the inner circumferential surface of fixation belt 20 friction force generated between nip forming member 10 and the inner circumferential surface of fixation belt 20 can be lowered. The slip phenomenon can thus be suppressed.

By applying at lubricant between nip forming member 10 and fixation belt 20, friction force generated between nip forming member 10 and the inner circumferential surface of fixation belt 20 can further be lowered.

By providing lubricant application portion 90, the lubricant can uniformly be applied to the inner circumferential surface of fixation belt 20. Heat conduction from healing roller 42 to fixation belt 20 can thus be uniform. Furthermore, an amount of wear of the inner circumferential surface of fixation belt 20 or slide sheet 60 can be stabilized in width direction DR3.

(Modification)

Figure 10:
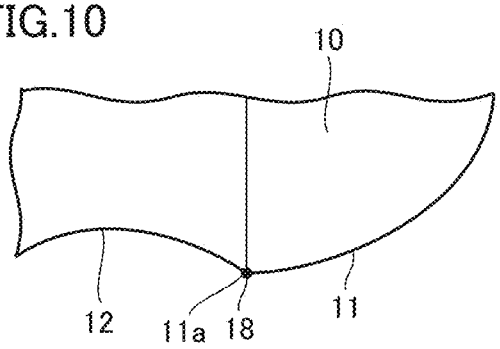
FIG. 10 is a diagram showing one example of a curvature boundary portion.

FIG. 10 is a diagram showing one example of curvature boundary portion 18. Nip downstream portion 12 in a modification is curved in a direction opposite to a direction of curving of nip upstream portion 11. Unlike the embodiment, nip upstream portion 11 in the modification is in a shape of an arc of an oval. Curvature boundary portion 18 is formed at a boundary between nip upstream portion 11 and nip downstream portion 12. Curvature boundary portion 18 is formed at a portion of change from a curvature of nip upstream portion 11 to a curvature different therefrom.

An oval is not constant in its curvature. Therefore, when nip upstream portion 11 is in a shape of an arc of an oval, the "curvature different therefrom (different from the curvature of nip upstream portion 11)" is defined as a "curvature different from a curvature at a most downstream portion 11*a* of nip upstream portion 11 in direction of transportation DR1."

EXAMPLES

A test for evaluating, glossiness was conducted with a nip forming member of which path difference (=2π×t×θ/360) was adjusted by varying upstream nipping angle θ[°]. Average particle size x [μm] of toner was 6 [μm]. Thickness t [μm] of a toner image was determined as below.

Figure 11:
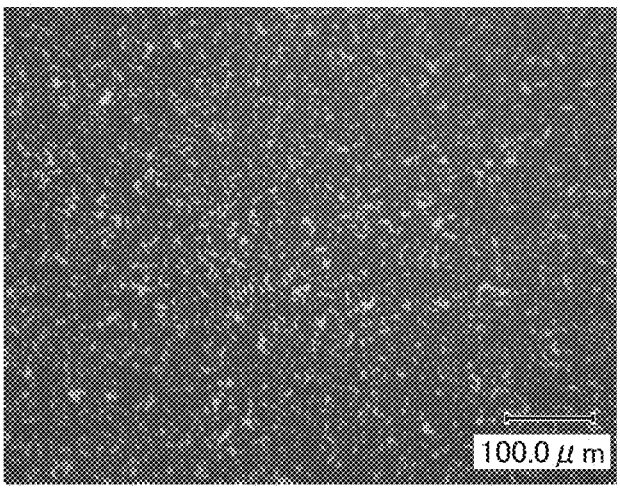
FIG. 11 shows a photograph of a surface of a toner image as being enlarged.
Figure 12:
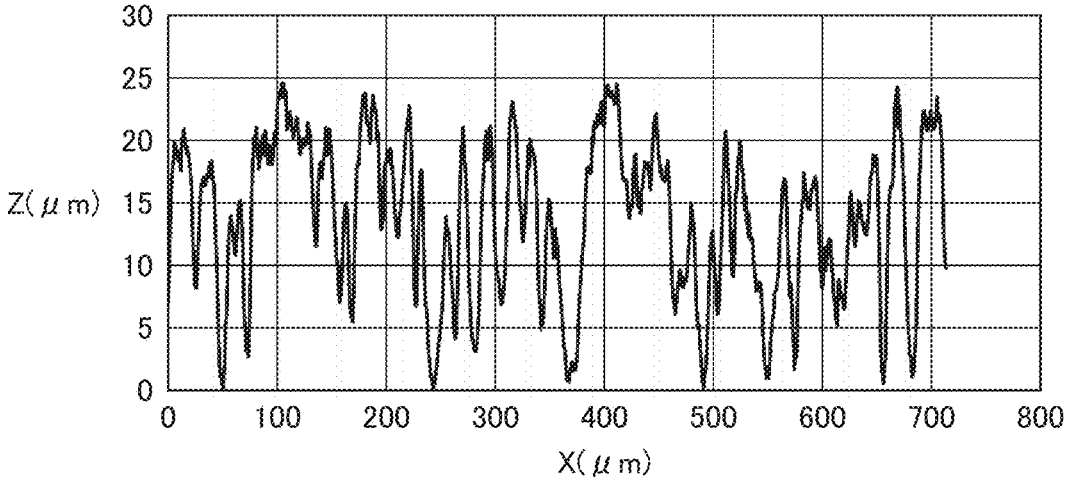
FIG. 12 is a diagram showing a result of profiling of a shape of a toner image in an example of a single layer.

FIG. 11 shows a photograph of a surface of loner image 50 as being enlarged. FIG. 12 is a diagram showing a result of profiling of a shape of toner image 50 in an example of a single layer. The abscissa in FIG. 12 represents a length X [μm] in a direction in which paper S extends and the ordinate represents a height Z [μm] of toner image 50 in the thickness direction. A thickness of toner image 50 was measured with a contactless laser scanning microscope (VKX-1000).

A white portion shown in FIG. 11 represents an underlay (paper). A maximum value of height Z [μm] of toner image 50 (that is, a length from the underlay (paper S) to a surface layer (surface portion 51)) was defined as thickness t [μm] of toner image 50. Based on a result in FIG. 12, in the example of a single layer, toner image 50 had thickness t [μm] of 25 [μm].

Figure 13:
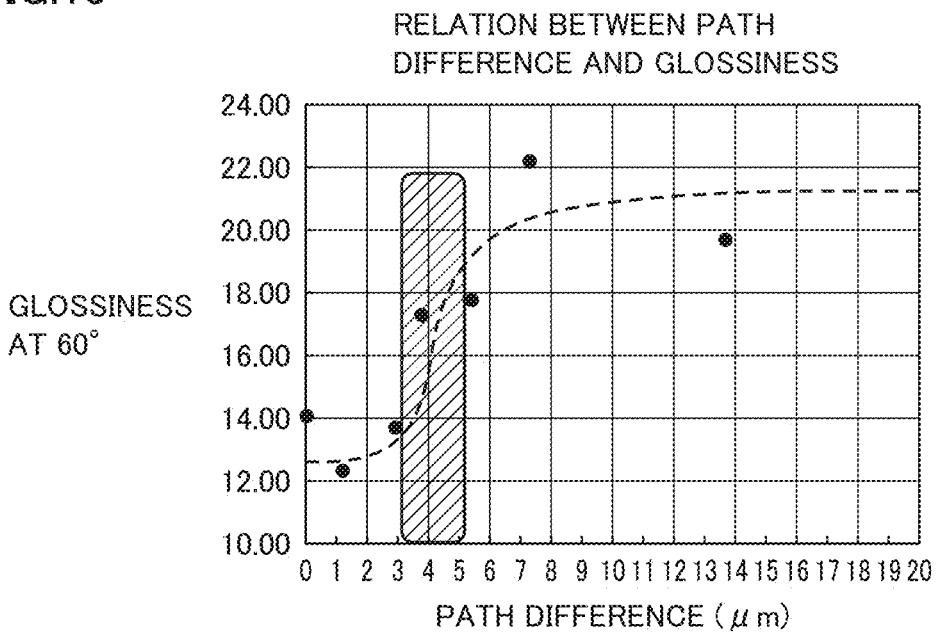
FIG. 13 is a diagram of plotted results of glossiness with respect to a path difference.

FIG. 13 is a diagram of plotted results of glossiness with respect to a path difference. The abscissa in FIG. 13 represents a path difference [μm] and the ordinate represents glossiness, in measurement of glossiness in FIG. 13, an incident angle was set to 60[°] (glossiness at 60°). FIG. 13 shows an approximation curve of the plot with a dotted line.

In a region where a path difference was small (a region where the path difference was not smaller than 0 [μm] and around 2 [μm]), glossiness was approximately from 12 to 14, whereas in a region where the path difference was large (a region where the path difference was not smaller than 6 [μm] and not greater than 14 [μm]), glossiness was approximately from 20 to 22. It could be confirmed from this result that glossiness was increased by increasing the path difference.

It can be seen in the result in FIG. 13 that an effect of increase in glossiness starts to appear in a region where the path difference is not smaller than 3 [μm] and not greater than 5 [μm] (a hatched portion in FIG. 13). An effect of increase in glossiness is obtained by providing a path difference not smaller than half the average particle size of 6 [μm] of toner (≈ an amount of displacement) (half (3 [μm]) the average particle size of 6 [μm] of toner being defined as the lower limit value of the path difference). Glossiness can effectively be increased by satisfying a relational expression (1) below, where x [μm] represents an average particle size of toner and t [μm] represents a thickness of a toner image.

$$x/2 \leq 2\pi \times t \times \theta/360 \quad (1)$$

It can further be seen that, when the path difference is from 4 [μm] to around 5 [μm], a value of glossiness increased by approximately 4 as compared with glossiness when the path difference was around 3 [μm], and an effect of further increase in glossiness is obtained. It can thus be seen that an effect of further increase in glossiness is obtained by providing a path difference not smaller than ⅔ (4 [μm]) of the average particle size of 6 [μm] of toner. Glossiness can more effectively be increased by satisfying a relational expression (2) below.

$$(2/3) \times x \leq 2\pi \times t \times \theta/360 \quad (2)$$

It can further be seen that, when the path difference is 6 [μm], glossiness is approximately from 20 to 22 and an effect of increase in glossiness is noticeably obtained. A value of glossiness can be increased by approximately at least 6 and at most 10 by providing a path difference not smaller than 6 [μm] which is equal to the average particle size of toner. Glossiness can more noticeably be increased by satisfying a relational expression (3) below.

$$x \leq 2\pi \times t \times \theta/360 \quad (3)$$

When glossiness is to be increased by approximately at least 6 and at most 10, with an approach to increase glossiness based on a nip width (a width of fixation nip portion N in direction of transportation DR1), the nip width should be increased by approximately 2 [mm], and with an approach to increase glossiness based on a fixation temperature, the fixation temperature should be increased by approximately 10[° C.]

It was shown that glossiness could effectively be increased by providing a path difference not smaller than half average particle size x [μm] of toner, without increasing a nip width (a duration of nipping) or a fixation temperature.

On the other hand, too large a path difference is disadvantageous. As described above, an interval of exposure and a resolution (dpi) of the image forming apparatus are subject to conditions. Therefore, when toner is displaced by one or more dots, another color may be superimposed and color shift may occur. Therefore, there is an upper limit of the path difference (an amount of displacement). Glossiness can be increased and color shift can be suppressed by satisfying a relational expression (4) below where d [dpi] represents a resolution of a finalized toner image to be formed on paper S.

$$2 \times \pi \times t \times \theta/360 \leq 25.4 \times 10^3/d \quad (4)$$

The figure $25.4 \times 10^3/d$ represents a length [μm] per one dot.

Figure 14:
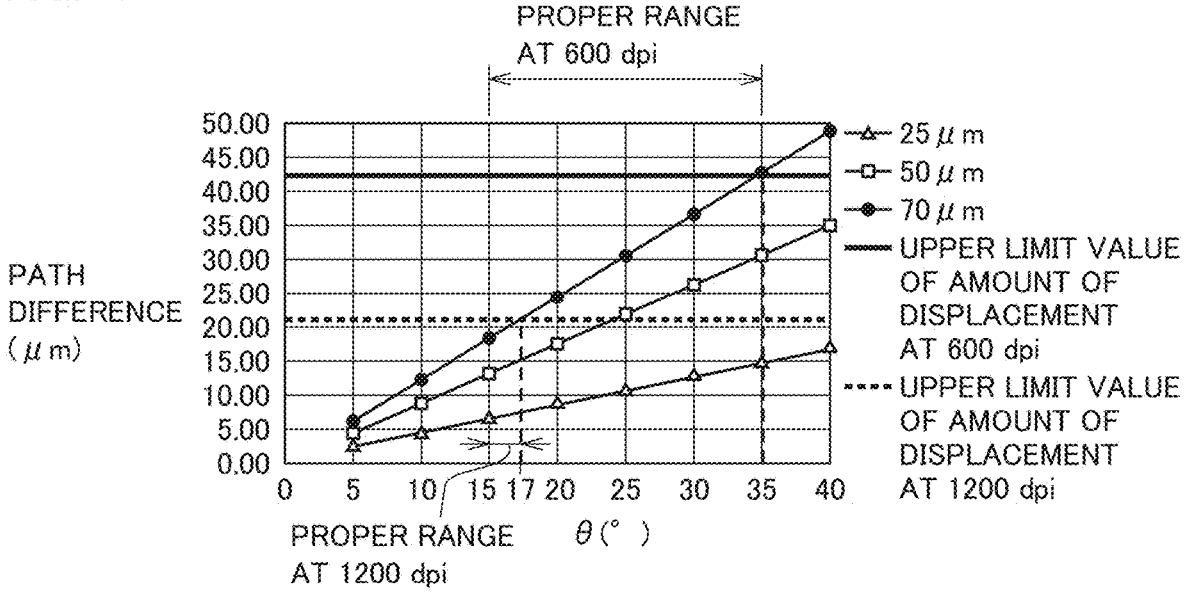
FIG. 14 is a diagram for deriving a proper upstream nipping angle θ[°].

FIG. 14 is a diagram for deriving a proper upstream nipping angle θ[°]. In FIG. 14, a path difference (=2×π×t×θ/360) corresponding to upstream nipping angle θ[°] is plotted for each of examples of toner images having thicknesses of 25 [μm] (a solid image of one layer), 50 [μm], and 70 [μm] solid image of four layers).

An upper limit value of the path difference was set, with exemplary general resolutions of 600 [dpi] and 1200 [dpi] being considered. When the resolution is set to 600 [dpi], a limit of an amount of displacement is 42.3 ($=25.4 \times 10^3/600$) [μm], and when the resolution is set to 1200 [dpi], a limit of an amount of displacement is 21.2 ($=25.4 \times 10^3/1200$) [μm].

Since the result shows that glossiness increased from the setting of the path difference to approximately at least 6 [μm] (see FIG. 13), θ=15° was set as a lower limit value. The upper limit of upstream nipping angle θ[°] in an example of a toner image having a thickness of 70 [μm] and a resolution set to 600 [dpi] was θ=35°. Thus, at 600 [dpi], a range not smaller than 15[°] and not greater than 35[°] is proper for upstream nipping angle θ[°].

The upper limit of upstream nipping angle θ[°] in an example of a toner image having a thickness of 70 [μm] and a resolution set to 1200 [dpi] was θ=17°. Thus, at 1200 [dpi], a range not smaller than 15[°] and not greater than 17[°] is proper for upstream nipping angle θ[°].

As set forth above, upstream nipping angle θ[°] at which an amount of displacement does not exceed the limit can be found as 15≤θ≤17 in any of an example of a resolution at 600 [dpi] and an example of a resolution at 1200 [dpi]. Color shift can reliably be suppressed by upstream nipping angle θ[°] satisfying relation of 15≤θ≤17.

(Others)

Heating portion 40 may be arranged in pressure roller 30 and pressure roller 30 may heat fixation belt 20. In this case, pressure roller 30 heated by heating portion 40 supplies heat to toner image 50.

The construction of the fixation apparatus and the image forming apparatus in the embodiment described above and the functions and effects achieved by the fixation apparatus and the image forming apparatus are summarized as below.

A fixation apparatus fixes a toner image formed on a recording medium. The fixation apparatus includes a fixation belt, an opposing rotating body, a nip forming member, and a heating portion. The endless fixation, belt is rotatably constricted. The nip forming member is arranged on an inner circumferential side of the fixation belt. The opposing rotating body is opposed to the nip forming member and an outer circumferential surface of the fixation belt to form a fixation nip portion. The heating portion supplies heat to the toner image. In the nip forming member, a nip most upstream portion corresponding to a most upstream portion of the fixation nip portion in a direction of transportation of the recording medium is defined. The nip forming member includes a curved nip upstream portion which is provided at the nip most upstream portion and projects with respect to the opposing rotating body. The nip upstream portion is shaped to produce a speed difference between a side of the toner image where the toner image and the fixation belt are in contact with each other in a thickness direction of the recording medium and a side of the toner image where the toner image and the recording medium are in contact with each other in the thickness direction.

In the fixation apparatus, the nip forming member includes a nip downstream portion which is different curvature from the nip upstream portion and provided downstream from the nip upstream portion in the direction of transportation.

In the fixation apparatus, relation of $x/2 \leq 2\pi \times t \times \theta/360$ is satisfied, where θ[°] represents an angle formed between a line segment which connects a boundary between the nip upstream portion and the nip downstream portion to a center of curvature of the nip upstream portion and a line segment which connects the nip most upstream portion to the center of curvature in a cross-section orthogonal to a width direction of the fixation belt, t [μm] represents a thickness of the toner image, and x [μm] represents an average particle size of toner which forms the toner image.

In the fixation apparatus, relation of $2\pi \times t \times \theta/360 \leq 25.4 \times 10^3/d$ is satisfied, where d [dpi] represents a resolution of a finalized toner image formed on the recording medium.

In the fixation apparatus, the angle θ[°] satisfies relation of $15 \leq \theta \leq 17$.

In the fixation apparatus, the fixation belt includes an elastic layer.

In the fixation apparatus, the nip upstream portion is lower in nipping pressure than a portion in the nip forming member other than the nip upstream portion.

In the fixation apparatus, toner which forms the toner image contains wax.

In the fixation apparatus, the toner contains at least 10% and at most 20% of the wax with respect to a weight of the toner.

In the fixation apparatus, the nip forming member is configured to have a nipping pressure increasing toward downstream in the direction of transportation.

The fixation apparatus further includes a slide sheet. The slide sheet is arranged between the nip forming member and the fixation belt. The slide sheet lowers friction force.

In the fixation apparatus, a lubricant is applied between the nip forming member and the fixation belt.

The fixation apparatus further includes a lubricant application portion which uniformly applies the lubricant to an inner circumferential surface of the fixation belt.

An image forming apparatus includes the fixation apparatus in any aspect above and an accommodation portion which accommodates a recording medium to be transported to the fixation apparatus.

Although embodiments of the present invention have been described and illustrated in detail, the disclosed embodiments are made for the purposes of illustration and example only and not limitation. The scope of the present invention should be interpreted by terms of the appended claims.

What is claimed is:

1. A fixation apparatus for fixing a toner image formed on a recording medium, the fixation apparatus comprising:

a rotatable endless fixation belt;

a nip forming member arranged on an inner circumferential side of the fixation belt;

an opposing rotating body opposed to the nip forming member and an outer circumferential surface of the fixation belt to form a fixation nip portion; and a heating portion which supplies heat to the toner image, the nip forming member including a curved nip upstream portion, the curved nip upstream portion having a nip most upstream portion corresponding to an entrance to the fixation nip portion, and the curved nip upstream portion being positioned at a most upstream portion of the fixation nip portion in a direction of transportation of the recording medium, the curved nip upstream portion being arced outward and pressing into the opposing rotating body, the curved nip upstream portion being shaped to produce a speed difference between a side of the toner image where the toner image and the fixation belt are in contact with each other in a thickness direction of the recording medium and a side of the toner image where the toner image and the recording medium are in contact with each other in the thickness direction, the nip forming member further includes a planar nip downstream portion which is adjacent to and downstream from the curved nip upstream portion in the direction of transportation, and relation of $x/2 \leq 2\pi \times t \times \theta/360$ is satisfied, where θ [°] represents an angle formed between a line segment which connects a boundary between the curved nip upstream portion and the planar nip downstream portion to a center of curvature of the curved nip upstream portion and a line segment which connects the nip most upstream portion to the center of curvature in a cross-section orthogonal to a width direction of the fixation belt, t [μm] represents a thickness of the toner image, and x [μm] represents an average particle size of toner which forms the toner image.

2. The fixation apparatus according to claim 1, wherein relation of $27\pi \times t \times \theta/360 \leq 25.4 \times 10^3/d$ is satisfied, where d [dpi] represents a resolution of a finalized toner image formed on the recording medium.

3. The fixation apparatus according to claim 1, wherein the angle θ [°] satisfies relation of $15 \leq \theta \leq 17$.

4. The fixation apparatus according to claim 1, wherein the fixation belt includes an elastic layer.

5. The fixation apparatus according to claim 1, wherein the curved nip upstream portion is lower in nipping pressure than a portion in the nip forming member other than the curved nip upstream portion.

6. The fixation apparatus according to claim 1, wherein toner which forms the toner image contains wax.

7. The fixation apparatus according to claim 6, wherein the toner contains at least 10% and at most 20% of the wax with respect to a weight of the toner.

8. The fixation apparatus according to claim 1, wherein the nip forming member is configured to have a nipping pressure increasing toward downstream in the direction of transportation.

9. The fixation apparatus according to claim 1, the fixation apparatus further comprising a slide sheet which is arranged between the nip forming member and the fixation belt and lowers friction force.

10. The fixation apparatus according to claim 1, wherein a lubricant is applied between the nip forming member and the fixation belt.

11. The fixation apparatus according to claim 10, the fixation apparatus further comprising a lubricant application portion which uniformly applies the lubricant to an inner circumferential surface of the fixation belt.

12. An image forming apparatus comprising:

the fixation apparatus according to claim 1; and an accommodation portion which accommodates the recording medium to be transported to the fixation apparatus.

* * * * *